US006084902A

United States Patent [19]

Hawk

[11] Patent Number: 6,084,902

[45] Date of Patent: Jul. 4, 2000

[54] ELECTRIC ARC FURNACE HAVING MONOLITHIC WATER-COOLED ROOF

[75] Inventor: Christopher Hawk, Kannapolis, N.C.

[73] Assignee: Fuchs Systems, Inc., Salisbury, N.C.

[21] Appl. No.: 09/350,881

[22] Filed: Jul. 9, 1999

[51] Int. Cl.[7] ..... F27D 1/02

[52] U.S. Cl. ..... 373/74; 373/71

[58] Field of Search ..... 373/71–76

[56] References Cited

U.S. PATENT DOCUMENTS

| | | | |
|---|---|---|---|
| 4,182,610 | 1/1980 | Mizuno et al. | 373/74 |
| 4,216,348 | 8/1980 | Greenberger | 373/74 |
| 4,345,332 | 8/1982 | Wronka | 373/74 |
| 4,553,245 | 11/1985 | Kerr | 373/74 |
| 4,633,480 | 12/1986 | Bleimann | 373/74 |
| 4,638,492 | 1/1987 | Kerr | 373/74 |
| 4,644,558 | 2/1987 | Kerr | 373/74 |
| 4,813,055 | 3/1989 | Heggart et al. | 373/74 |
| 4,849,987 | 7/1989 | Miner, Jr. et al. | 373/74 |
| 5,241,559 | 8/1993 | Hixenbaugh | 373/74 |
| 5,289,495 | 2/1994 | Johnson | 373/74 |
| 5,327,453 | 7/1994 | Arthur et al. | 373/74 |

*Primary Examiner*—Tu Ba Hoang
*Attorney, Agent, or Firm*—Allen, Dyer, Doppelt, Milbrath & Gilchrist, P.A.

[57] ABSTRACT

An electric arc furnace includes a substantially cylindrically configured melting vessel having an upper shell defining a top opening. A water-cooled roof assembly is supported by the upper shell and positioned over the top opening and can be removed from the top opening for permitting the charging of scrap into the melting vessel. The water-cooled roof assembly includes an annular configured, water-cooled outer roof panel defining a central opening. An annular configured, water-cooled inner roof panel is positioned within the central opening of the outer roof panel and is removably mounted on the outer roof panel. The inner roof panel includes a central opening that removably mounts a central refractory. At least one electrode is mounted in the central refractory and extends into the melting vessel.

44 Claims, 7 Drawing Sheets

ELECTRIC ARC FURNACE HAVING MONOLITHIC WATER-COOLED ROOF

FIELD OF THE INVENTION

This invention relates to electric arc furnaces, and more particularly, to electric arc furnaces having water-cooled roof assemblies.

BACKGROUND OF THE INVENTION

Electric arc furnaces are used in the production of steel from scrap iron and other metals. The electric arc furnaces typically include a substantially cylindrically configured melting vessel having an upper shell that defines a top opening. Water-cooled panels form the inside surface of the upper shell. A water-cooled roof assembly is supported by the upper shell and positioned over the top opening. A lower shell includes a refractory brake lining, or the like, where the molten steel is melted by means of at least one electrode, and typically three electrodes in an AC furnace. The electrodes are mounted in the central refractory located in the water-cooled roof assembly and extend into the melting vessel to provide the electrical current to melt the scrap and provide the heat necessary for a steel melt.

A slag discharge opening can be formed under a water-cooled panel to allow discharge of the slag. The steel melt is discharged through an opening in the melting vessel when the melt (or heat) is complete.

The water-cooled roof assembly protects the structure against the high temperatures of the furnace and works in conjunction with the water-cooled panels formed on the inside surface of the melting vessel. In a standard design shown in the prior art of FIG. 1, a plurality of generally pie-shaped water-cooled panels are made from pipes and mounted between an outer ring and an inner ring. The "delta area" is formed from a refractory material and positioned in the central opening. Typically in an AC electric arc furnace, three electrodes extend through the refractory and into the furnace. A small exhaust opening is formed in one of the pie-shaped water-cooled panels to allow exhaust from operation of the electric arc furnace. The number of panels typically varies from 4–10 panels, and in the prior art of FIG. 1, four pie-shaped panels are illustrated.

This type of conventional water-cooled roof has been beneficial. When a pie-shaped water-cooled panel fails, the panel can be replaced with another spare water-cooled panel. However, this convenience has a price because the initial cost of a conventional roof, as illustrated in the prior art of FIG. 1, is greater because a more complicated roof design is necessary to hold the panels. Also, individual pie-shaped panels cost more. There is also an additional cost of a flexible hose piping system to supply and return water to each pie-shaped panel. The flexible hose connections increase the costs and increase the time in replacing an individual panel. The conventional/standard design as shown in prior art FIG. 1 also has pressure losses across the roof that are usually greater than the pressure losses found in a monolithic roof design, where there are fewer elbows.

A conventional monolithic roof design is shown in prior art FIG. 2, where only one water-cooled panel is formed by the roof and includes a central opening as in the prior art of FIG. 1. The monolithic roof design is initially lower in cost and is designed to include a larger water-cooled panel with multiple circuits formed in the shape of the roof. Usually the cooling pipes are rolled into a circle. The radius of each cooling pipe is smaller as the center of the roof is approached. A common header supplies and returns the cooling water. However, this one-piece roof, often referred to as a monolithic roof, does not permit economic replacement when cooling pipe damage has occurred. The roof must be repaired where the damage has occurred. When the damage is great, the roof will have to be removed and repaired elsewhere or, in a worse case scenario, scrapped, and a new roof purchased.

Typically, in both monolithic and in conventional water-cooled roofs, higher stresses and greater failure rates occur at the center of a roof section where the first few pipes closest to the refractory center are located. Thus, in a standard roof design, a pie-shaped panel will typically have only a small portion of a cooling pipe damaged by heat and stress. If an entire pie-shaped water-cooled panel is removed, it must be replaced with a new water-cooled panel, which increases the maintenance costs and wastes materials.

SUMMARY OF THE INVENTION

It is therefore an object of the present invention to provide an electric arc furnace having a water-cooled roof assembly that includes a monolithic roof panel, but facilitates ready replacement of the inner most cooling pipes adjacent the central refractory.

In accordance with the present invention, a novel electric arc furnace is designed that incorporates a monolithic roof design with a removable center portion formed as a water-cooled panel. The electric arc furnace includes a substantially cylindrically configured melting vessel having an upper shell defining a top opening. A water-cooled roof assembly is supported by the upper shell and positioned over the top opening. The water-cooled roof assembly can be removed from the top opening for permitting the charging of scrap into the melting vessel. The water-cooled roof assembly includes an annular configured, outer roof panel having an inner ring support member defining a central opening. An outer ring support member is supported by the upper shell. At least one cooling pipe forms a concentric series of water cooling pipes extending inward from the outer ring support member to the inner ring support member.

An annular configured, inner roof panel is positioned within the central opening of the outer roof panel and is removably mounted on the outer roof panel such that the inner roof panel can be removed from the outer roof panel when the outer roof panel is mounted over the top opening. The inner roof panel has at least one cooling pipe and forms a concentric series of cooling pipes extending inwardly. The inner roof panel includes a central opening. A central refractory, known as the "delta area" is removably mounted within the central opening of the inner roof panel. At least one electrode is mounted in the central refractory and extends into the melting vessel.

In accordance with one aspect of the present invention, the outer ring support member comprises an annular configured skirt portion supported on the outer shell. The cooling pipe includes a cooling pipe section that extends along the skirt portion. The inner ring support member includes a circumferentially extending upper flange member. The inner roof panel includes an annular support member having a circumferentially extending outer flange member that is mounted on the upper flange member of the inner ring support member. A plurality of pins extend through the upper flange member and outer flange member for securing together the outer and inner roof panels. The inner ring support member and annular support member form a U-shaped recess in which the water-cooled pipes from the outer and inner roof panels extend.

The inner roof panel further comprises an inner support surface, and the central refractory includes an outer support flange that mounts on the inner support surface. A plurality of pins extend through the inner support surface of the inner roof panel and outer flange of said central refractory.

In still another aspect of the present invention, the cooling pipe of the inner roof panel can include an inlet and outlet through which a cooling fluid flows to and from the cooling pipe. A tube connects the inlet and outlet to the cooling pipe of the outer roof panel to receive and discharge cooling fluid to and from the cooling pipe of the outer roof panel. The cooling pipe of the inner roof panel includes an inlet and outlet through which cooling fluid flows to and from the cooling pipe.

In still another aspect of the present invention, the outer roof panel, inner roof panel and central refractory are substantially frustoconically shaped to aid in dimensional stability to the roof assembly. A plurality of support ribs can extend along the outer roof panel from the outer ring support member to the inner ring support member. The central refractory can further comprise a water-cooled outer bevel. A mast support can extend over the melting vessel and support the water-cooled roof assembly. The mast support can be pivoted away from the melting vessel to allow the water-cooled roof assembly to be removed from the melting vessel.

In still another aspect of the present invention, the substantially cylindrically configured melting vessel has a plurality of water-cooled panels defining an inside surface of an upper shell and forms a top opening. A lower shell has a slag door portion through which slag can be discharged. An arcuate configured water-cooled panel can include opposite side ends and can be positioned above the slag door portion so that the lower end is angled inwardly away from an adjacent inside surface. The side ends can be formed to curve toward an adjacent inside surface of the upper shell to define a scrap free area.

In a method aspect of the present invention, scrap can be charged into a melting vessel by removing the water-cooled roof assembly of the melting vessel and placing scrap through an opening into the melting vessel. The water-cooled roof assembly is then closed and an electric arc is generated through the scrap by at least one electrode extending through the water-cooled roof assembly. An oxygen lance is extended through a slag discharge opening into the charging vessel.

BRIEF DESCRIPTION OF THE DRAWINGS

Other objects, features and advantages of the present invention will become apparent from the detailed description of the invention which follows, when considered in light of the accompanying drawings in which.

DETAILED DESCRIPTION OF THE PREFERRED EMBODIMENTS

The present invention is advantageous because it now permits an electric arc furnace to incorporate a monolithic roof design without the use of pie-shaped panels, and the possibility of changing only the innermost cooling pipes, adjacent the central refractory, without removing the main section of the monolithic roof from the melting vessel. Because cooling pipe failure occurs in the first 1–6 pipes from the center adjacent the "delta area," where the electrodes are mounted in the central refractory, this particular "failure prone" area is made as one separate water-cooled inner roof panel, which is easily removed without removing the outer roof panel. A spare inner roof panel can then be assembled with the central refractory. Thus, all the benefits of the monolithic roof (in terms of cost) are acquired, including the flexibility of a conventional roof with replaceable water-cooled panels.

Figure 1:
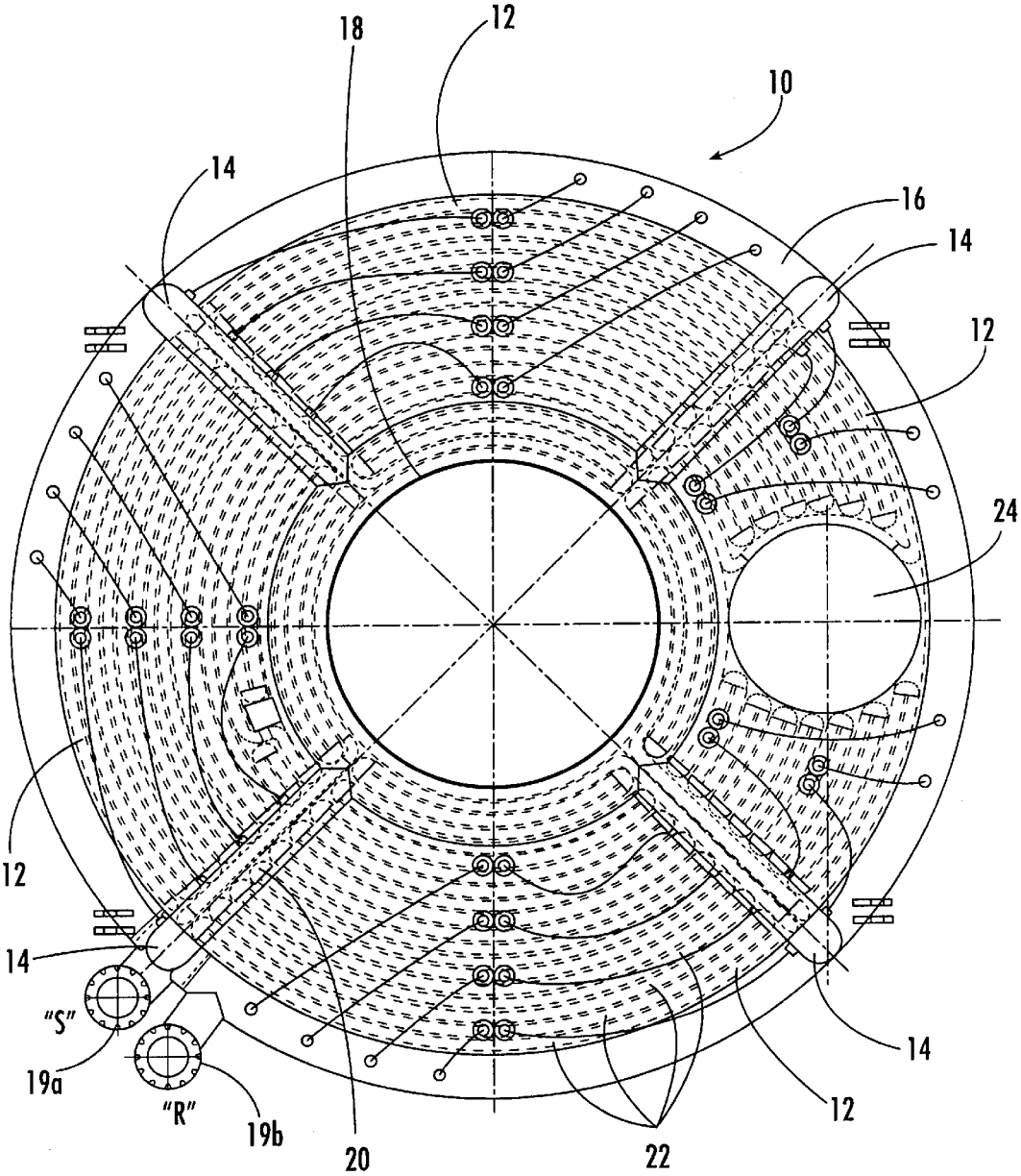
FIG. 1. PRIOR ART
FIG. 1 is a plan view of a prior art, conventional water-cooled roof assembly for use with an electric arc furnace showing four different pie-shaped water-cooled panels that are supported on four support ribs that extend between an outer ring support member and an inner ring support member.

FIG. 1 illustrates a conventional water-cooled roof 10 having four pie-shaped conventional water-cooled panels 12 that are supported on four support ribs 14 that extend between an outer ring 16 that rests upon an upper shelf of an electric arc furnace melting vessel, and an inner ring 18 that is adjacent a central refractory (not shown). This configuration includes one inlet 19*a* (or Source "S") and an outlet 19*b* (or Return "R"). As is known to those skilled in the art, the four pie-shaped water-cooled panels 12 are connected to each other by respective coolant header systems illustrated at 20, which connect to respective water-cooled cooling pipes 22. The cooling pipes 22 can be serpentine configured. The exhaust opening 24 from the melting vessel is formed in one of the water-cooled panels 12.

In the conventional design, when the innermost cooling pipes 22 of one of the pie-shaped water-cooled panels 12 are bad, the entire pie-shaped panel is removed and the innermost cooling pipes are then fixed, or the entire panel replaced.

Figure 2:
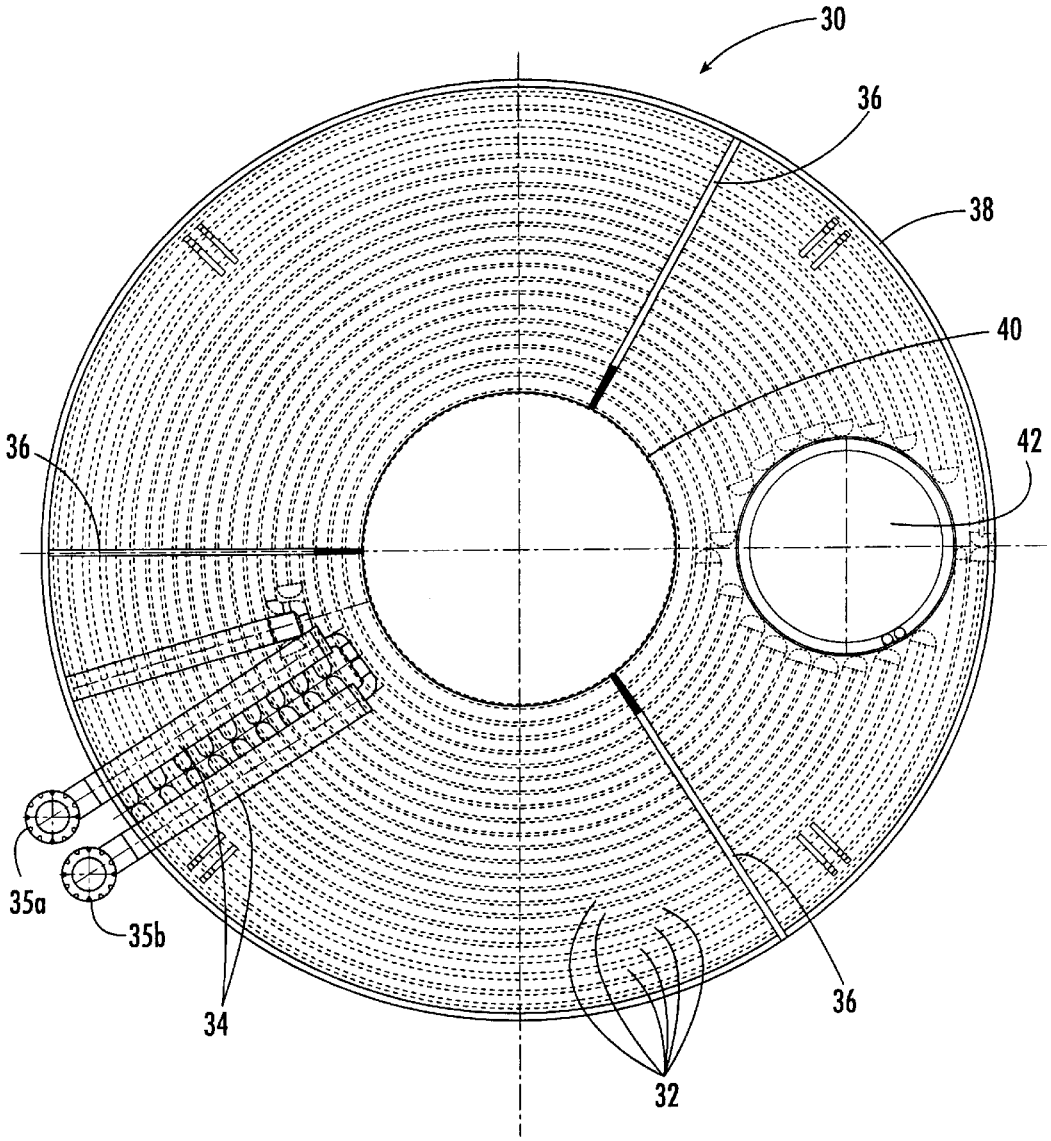
FIG. 2. PRIOR ART
FIG. 2 is a plan view of a prior art monolithic water-cooled roof assembly showing a plurality of cooling pipes formed in circles.

FIG. 2 prior art illustrates a monolithic roof design where the entire water-cooled roof assembly 30 is a monolithic (one piece) design. The cooling pipes 32 are rolled into a circle. The radius of each cooling pipe 32 is smaller as the center of the roof is approached. A common coolant header 34 supplies and returns the water through a respective inlet and outlet 35*a*, 35*b*. Three support ribs 36 are spaced about 120° apart and connect to an outer support ring 38 and an inner support ring 40 to provide additional strength to the structure. The roof design is typically frustoconically shaped similar to an arch to give added strength as in the well known structure of an arch. A central refractory (not shown) is used to support electrodes. An exhaust opening 42 is also formed in the monolithic roof design as in the standard conventional design.

The drawback of the prior art of FIG. 2 roof design is that most of the failure occurs in the first 1–6 cooling pipes 32 adjacent the center. The roof must be repaired where the damage has occurred, and if the damage is great, the roof will have to be removed and repaired elsewhere or scrapped. A new roof must then be purchased.

Figure 3:
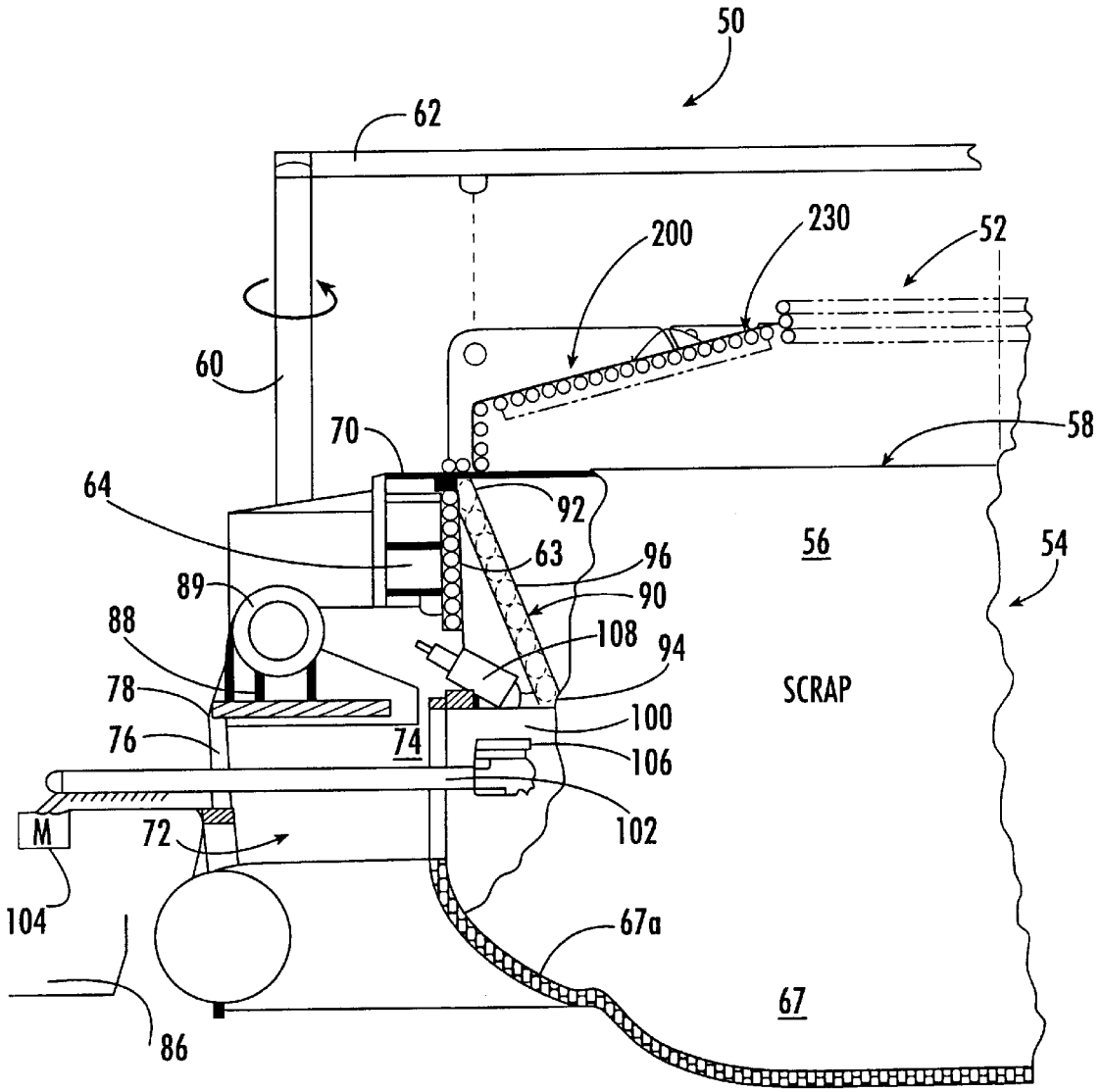
FIG. 3 is a schematic, sectional view of an electric arc furnace of the present invention and showing a water-cooled roof assembly having the outer roof panel and inner roof panel.
Figure 3A:
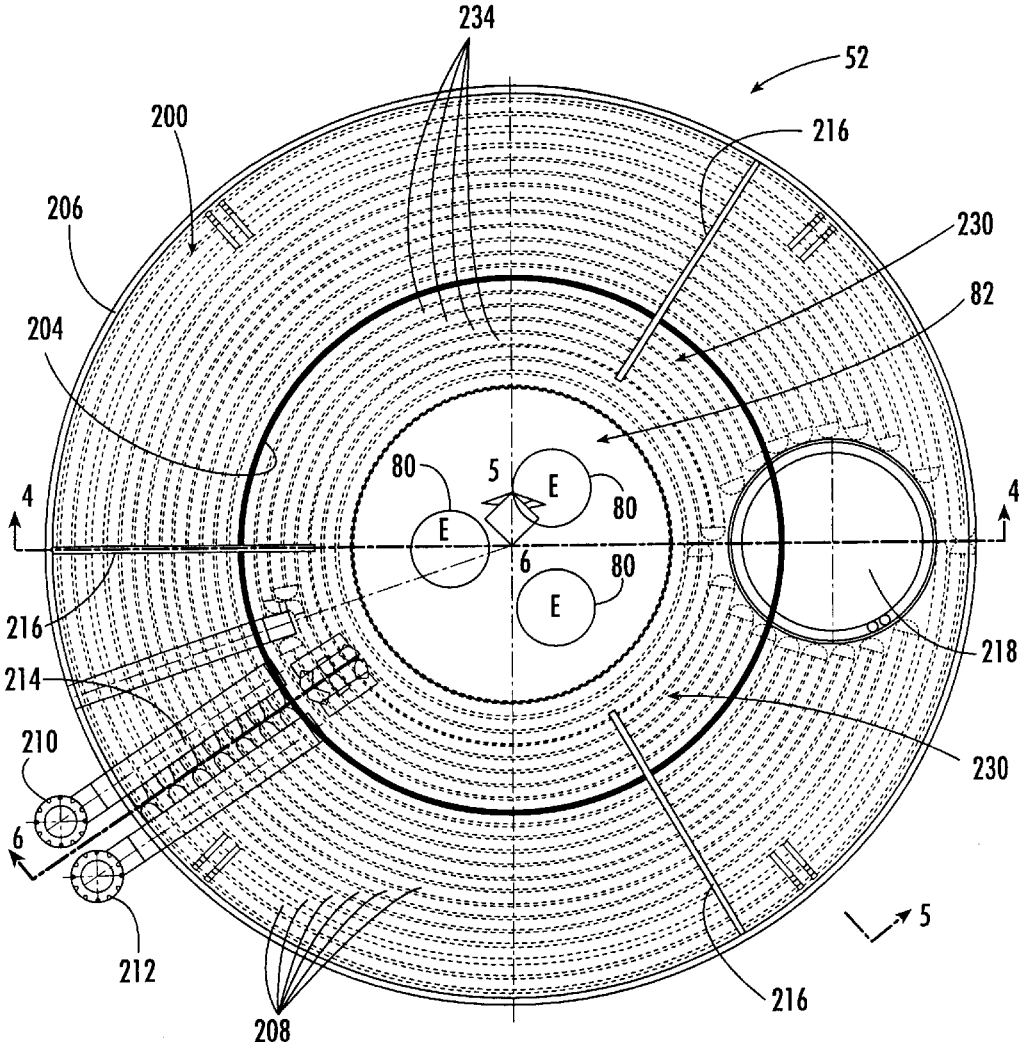
FIG. 3A is a top plan view of the water-cooled roof assembly of the present invention, showing an inlet and outlet and the annular configured inner and outer roof panels, and the electrodes that extend through the central refractory.

An electric arc furnace 50 of the present invention is illustrated in the schematic, sectional view of FIG. 3, and the novel water-cooled roof assembly 52 of the present invention is shown in plan view in FIG. 3A. For purposes of description, the electric arc furnace 50 is first described relative to the substantially cylindrically configured melting vessel 54 and upper shell 56 defining the top opening 58. The water-cooled roof assembly 52 is then described in greater detail.

FIG. 3 illustrates an electric arc furnace of the present invention, illustrated generally at 50, which includes a substantially cylindrically configured melting vessel 54. Generally, the term "cylindrically configured" could include oval and other designs known to those skilled in the art. The removable water-cooled roof assembly 52 can be supported by a post 60 and mast support 62, which pivots on the post 60 to allow the roof assembly 52 to be pivoted and removed from the melting vessel 54 for charging of scrap through the top opening 58 of the melting vessel. An inside wall surface 64 is defined by cooling panels. Typically, the electric arc furnace 50 is cylindrically or oval configured as described before, and can range in diameter from 15 feet to 45 feet or more, depending on the type and quantity of the desired melt.

In the electric arc furnace illustrated in FIG. 3, a portion of the upper shell 56 is illustrated. A plurality of water-cooled panels 63 are mounted to define the inside wall surface 64 of the upper shell 56, and form the cooling panels necessary for steelmaking. In some electric arc furnaces, a refractory material can be substituted for the water-cooled panels, but this is not the norm. A lower shell 67 (FIG. 3) is positioned below the upper shell 56, and usually includes a refractory material, such as brick 67*a*, lining the inside wall surface of the lower shell. The electric arc furnace has a top flange 70.

As illustrated, a slag door portion 72 is formed in the melting vessel 54, typically below the area formed by the upper shell 56 and water-cooled panels 63, and defines a slag discharge opening 74 through which slag can be discharged from the melting vessel 54 during a melt. A slag door 76 is positioned over the slag discharge opening 74 and is removable for exposing the slag discharge opening 74 and allowing an operator to view the melt during furnace operation. It also allows the positioning of an oxygen lance through the slag discharge opening 74 into the melting vessel 54. The slag door 76 can be moved to expose the slag discharge opening 74 by a conventional means known to those skilled in the art, such as an illustrated sliding mechanism 78 or other means.

One or more electrodes 80 extend into and through the "delta area" formed by a central refractory 82 (FIG. 3A). In the illustrated AC electric arc furnace, three electrodes 80 are illustrated, formed in a "delta" configuration, as is well known to those skilled in the art. The electric arc furnace 50 is typically about 15 to 45 feet in diameter, but varies depending on the desired design and end use. As noted before, the upper shell 56 can include a refractory material instead of the water-cooled panels 63.

As is well known to those skilled in the art, burners (not shown) are typically positioned at predetermined locations around the inside wall surface and provide the preheating to aid in melting the scrap. Also, a plurality of water-cooled oxygen injectors (not shown) are typically positioned at predetermined locations around the inside wall surface and can provide primary oxygen flow and secondary oxygen flow for post combustion. The water-cooled panels 63 defining the inside wall surface of the upper shell 56 provide the cooling means necessary for electric arc furnace operation.

The slag door 76 is positioned at the side of the melting vessel 54 and defines the slag discharge opening 74 through which slag can be discharged from the melting vessel during a melt. The movable slag door 76 covers the slag discharge opening during a melt. A slag pit 86 is positioned outside the melting vessel 54 under the slag discharge opening 74 and collects the slag discharged through the slag discharge opening 74 during the melt. The slag door 76 can be mounted on a sliding mechanism 88 or appropriate means and moved by an appropriate motor mechanism 89 or other suitable means, even by manual operation.

An arcuate configured water-cooled panel, illustrated generally at 90, can be positioned above the slag door 76 and includes opposing respective upper and lower ends 92, 94 and opposing side ends 96, and is positioned above the slag door 76 so that the lower end 94 is angled inwardly away from an adjacent inside wall surface of the melting vessel 54. The side ends 96 can be curved toward the adjacent inside wall surface of the melting vessel 54 to minimize any arcing between the opposing side ends 96 and the electrode 80 extending through the removable water-cooled roof assembly 52. The unexposed side ends 96 also reduce the likelihood of physical damage to the water-cooled panel. The arcuate configured water-cooled panel 90 forms an "awning" structure that has no exposed corners.

The area immediately underneath the arcuate configured water-cooled panel 90 adjacent to the slag door 76 forms a scrap free area 100 in the location of the electric arc furnace, known also by those skilled in the art as the "breast". As illustrated, the "awning" effect of the panel 90 maintains this area inside the furnace adjacent to the slag door 76 and within the slag discharge opening 74 free of slag. The scrap free area 100 formed under the panel 90 also allows an oxygen lance 102 to be positioned a greater distance into the melting vessel 54. The oxygen lance 102 can be positioned on a drive assembly 104, which allows the oxygen lance to be moved during a heat through the slag discharge opening 74, into the "breast" of the furnace, without engaging slag. Because slag no longer fills the breast and slag door opening 74, a burner 106 can be positioned at the end of the oxygen lance 102 to aid in scrap heating. A burner 108 can also be positioned in the area behind the water-cooled panel 90 to provide a preheating flame on the scrap to aid in melting the scrap.

In the larger capacity electric arc furnaces, a water flow rate of 150 1/min.m$^2$ (3.65 gpm/ft$^2$) for a side wall water-cooled panel or 170 1/min.m$^2$ (4.14 gpm/ft$^2$)for a roof water-cooled panel should be available. For DC furnaces, an even greater water flow rate through a cooling pipe should be available, typically, at least a 10–20 1/min.m$^2$ (0.25–0.5 gpm/ft$^2$) more depending on arc power and arc voltage. If too much scrap is placed in the furnace so that the distance between the scrap and roof is short, additional water is required. Water for various panels can be provided by a circumferentially extending water channel formed along or under the rim or top flange 70 of the furnace.

If enough water is available for these sustained flow rates, the overall quality or hardness of the water is of secondary importance. However, softer water will extend the life of a water-cooled panel.

During furnace operation, the transfer of heat through the cooling pipe into the water generates steam bubbles at the inner surface of the pipe. The energy required to form these steam bubbles is extracted from the hot pipe, causing heat transfer, resulting in a cooling mechanism. The steam bubbles are transported away from the surface to prevent coagulation and the formation of larger bubbles, which would insulate the pipe from the water, reducing the cooling effect.

In that case, a deposit of calcium carbonate would be formed on the inner surface of the pipe, decreasing the heat transfer. This could cause cracking of the pipe parallel to the water flow direction.

In general, a minimum water flow velocity of 2.5 m/sec or 8 ft/sec should be sufficient to remove the small steam bubbles from the pipe surface.

The water pressure exiting the water-cooled panel should also be above 20 psi to avoid starving of individual water-cooled panels and to achieve uniform flow rates. For a given incoming water pressure, different water flow rates and pressure drops will cause panel problems if the water flow drops below the critical rate.

Three different materials can be used for the water-cooled panels. The most common material used for the panel construction is standard boiler grade type A steel. This material may suffer some fatigue phenomenon. The temperature within the furnace vessel will typically cycle between 300° F. and 3200° F. This fluctuating temperature change and frequent expansion and contraction of the outer surface of the pipe will cause material failure and the pipe will break.

To combat the hot spots common in high powered melt electric arc furnaces, copper is more commonly used for the pipes. Copper pipes do not suffer fatigue like steel pipes and will, therefore, deliver a much longer life expectancy. Even at the higher price of a water-cooled panel, having copper pipes, many steel makers can justify the additional expense. Because copper pipe has a higher heat transfer coefficient than steel pipe, thicker slag layers can be formed on water-cooled panels having copper pipes. This results in reduced energy losses when compared to steel water-cooled panels.

If higher gas velocities and temperatures are present, pipes can be fabricated from another steel grade with chromium and molybdenum. Such materials deliver a higher strength at elevated temperatures than the regular boiler grade water-cooled panels.

Referring now to FIGS. 3A–8, the water-cooled roof assembly 52 of the present invention is shown in greater detail. The water-cooled roof assembly 52 of the present invention is supported by the upper shell 56 and positioned over the top opening 58 and can be removed as described before by pivoting the mast support 62 on the post 60 to permit the charging of scrap into the melting vessel.

As illustrated, the water-cooled roof assembly 52 of the present invention includes an annular configured, outer roof panel 200 that has an inner ring support member 202 that defines a central opening 204. An outer ring support member 206 is supported by the upper shell 56. At least one, and preferably a plurality of serpentine configured cooling pipes 208, form a concentric series of cooling pipes that extend inward from the outer ring support member 206 to the inner ring support member 202. An inlet and outlet 210,212 form a respective source and return for cooling fluids such as water and are connected into a source and return coolant header 214 to supply water to the respective cooling pipes 208 formed in the outer roof panel 200. Thus, cooling fluid flows to and from the cooling pipes 208.

Three support ribs 216 are spaced 120° apart and extend from the outer ring support member 206 to the inner ring support member 202 and provide additional support and stability to the structure forming the outer roof panel 200. In one part of the outer roof panel, an exhaust opening 218 is formed as shown in FIG. 3A, through which exhaust gas is evacuated from the melting vessel 54 when the water-cooled roof assembly of the present invention is placed over the top opening 58 and the electric arc furnace 50 is in operation. The outer ring support member 206 includes an annular configured skirt portion 220 supported on the upper shell 56 as shown in FIG. 1 and shown in greater detail in FIGS. 4–6, which illustrate the skirt portion. The serpentine configured cooling pipe 208 can include a cooling pipe section 208*a* that extends along the skirt portion.

In accordance with the present invention, an annular configured, inner roof panel 230 is positioned within the central opening 204 of the outer roof panel 200 and is removably mounted on the outer roof panel such that the inner roof panel can be removed from the outer roof panel, even when the outer roof panel is mounted over the top opening. In the embodiment shown in FIGS. 4–6, the inner roof panel 230 includes a beveled support ring 232 that engages against the inner ring support member 202, which can also be beveled to receive the beveled support ring 232 of the inner roof panel. Thus, the inner roof panel of the embodiment shown in FIGS. 4–6 can be tack welded, bolted, or fastened by other means known to those skilled in the art, to the outer roof panel 200.

Figure 7:
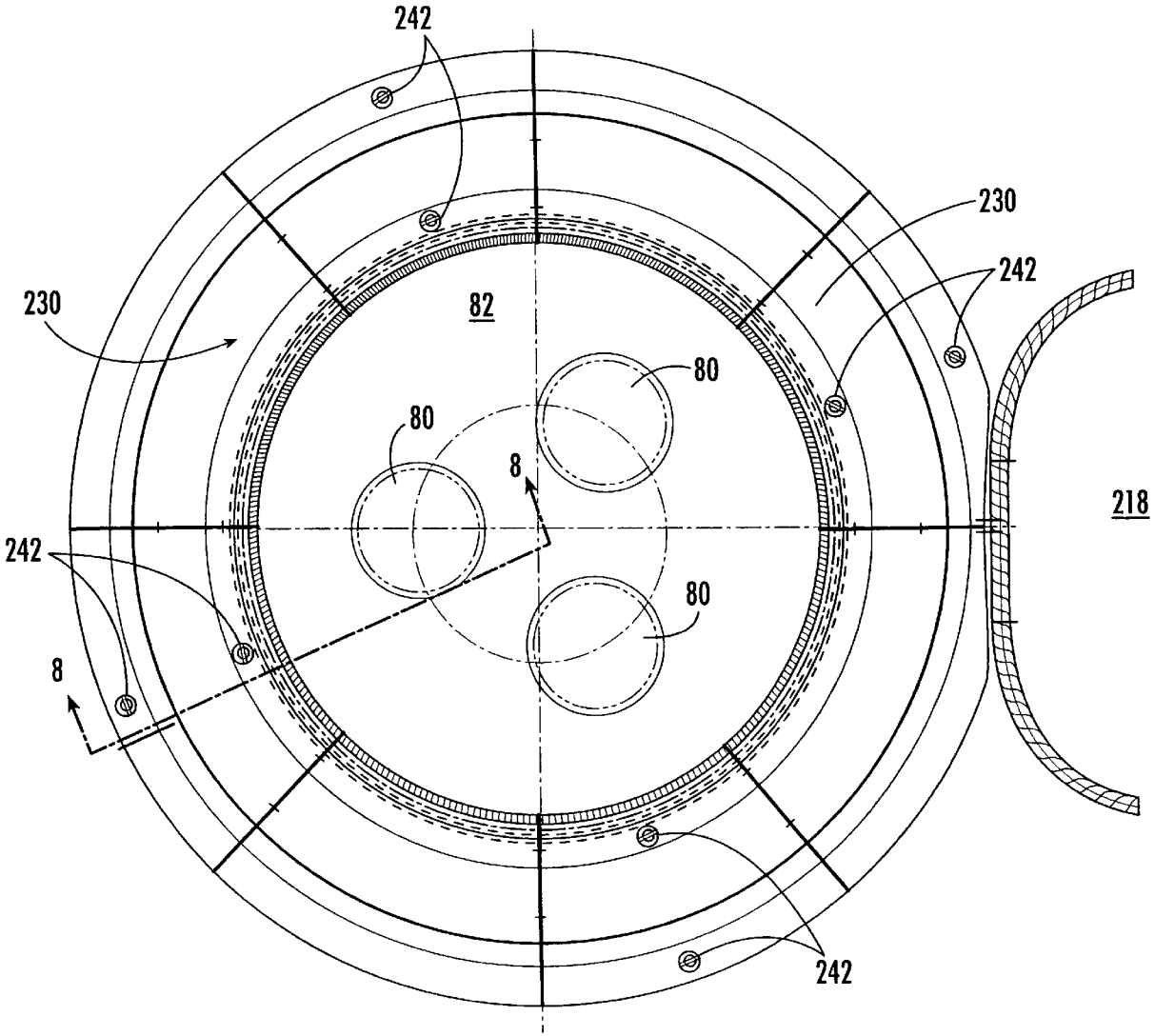
FIG. 7 is an enlarged, schematic plan view of the inner roof panel.
Figure 8:
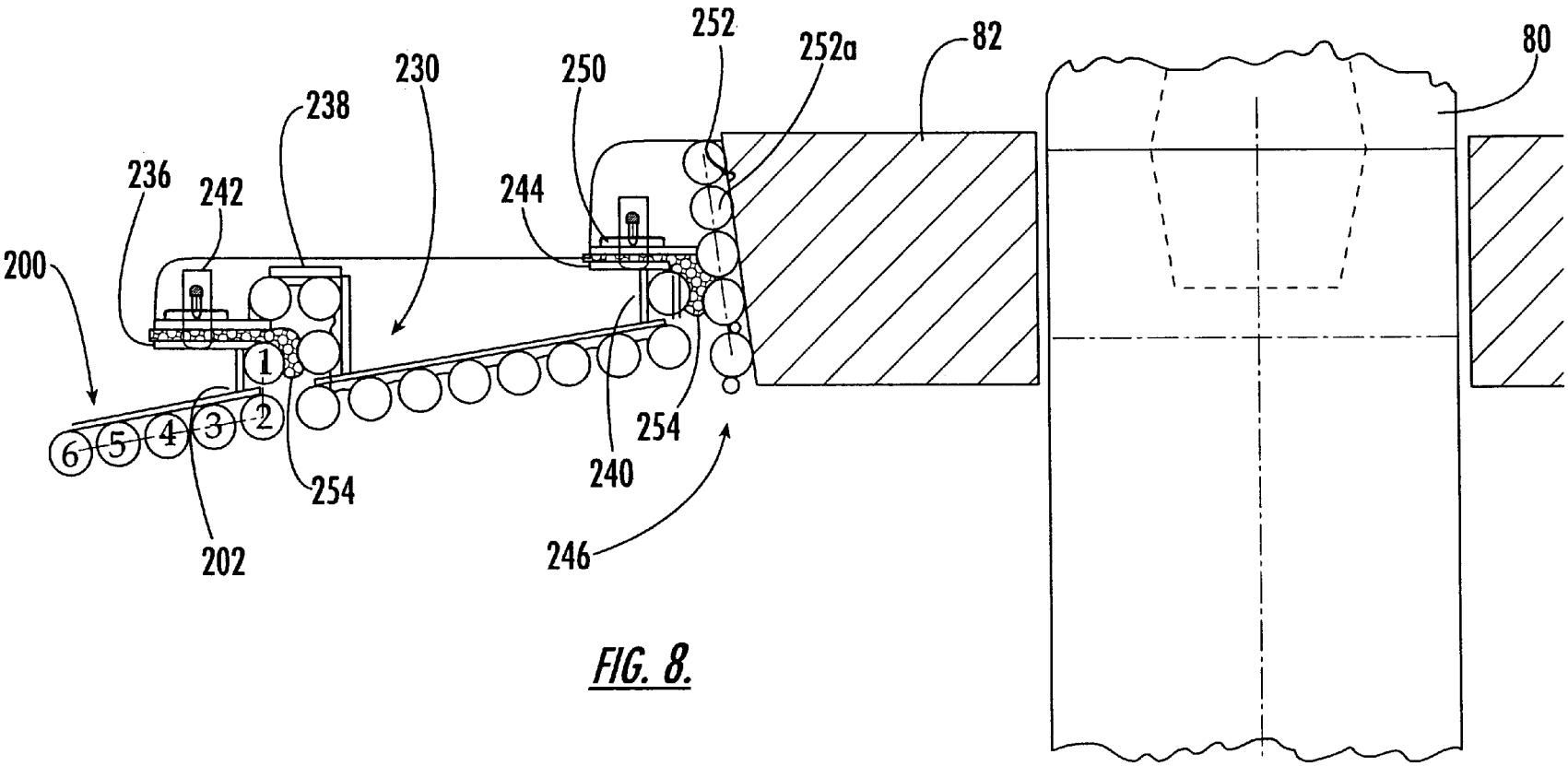
FIG. 8 is a schematic, sectional view taken along line 8—8 of FIG. 7, and showing a more detailed view of the inner roof panel, central refractory and a portion of the outer roof panel that supports the inner roof panel.

The inner roof panel 230 includes at least one, and preferably, a plurality of serpentine configured cooling pipes 234, which form a concentric series of water cooling pipes extending inwardly. The term "serpentine" can include the circular configuration, including the 180° bends as shown in FIG. 3A. One embodiment shown in FIGS. 7 and 8 illustrates a beneficial technique used for connecting the inner and outer roof panels 200, 230 together. As illustrated, the inner ring support member 202 includes a circumferentially extending upper flange member 236. The inner roof panel 230 includes an annular support member 238 having a circumferentially extending outer flange member 240 that is mounted on the upper flange member 236 of the inner ring support member 202. A plurality of pins 242 extend through the upper flange member 236 and outer flange member 240 and secure together the outer and inner roof panels 200, 230. Four two-inch pins can be used.

The inner roof panel 230 includes an inner support surface 244 forming a central opening 246. In the central opening 246, the central refractory 82 forming the delta area is received. The three electrodes 80 are mounted in the central refractory 82 and extend into the melting vessel as known to those skilled in the art. The central refractory 82 can be formed from bricks or other refractory material known to those skilled in the art.

The central refractory 82 includes an outer support flange 250 that mounts on the inner support surface 244 of the inner roof panel. A plurality of pins 242, which could be two-inch pins as used before, extend through the inner support surface 244 of the inner roof panel 230 and the outer support flange 250 of the central refractory 82. The central refractory 82 can include a water-cooled outer bevel 252 having cooling pipes 252*a*, as known to those skilled in the art. The respective connection points between the inner and outer roof panels 200, 230 and the inner roof panel 230 and central refractory 82 can incorporate a refractory material 254 that overlaps the respective connection points, as illustrated.

The inner ring support member 202 defined on the outer roof panel 200 and the annular support member 238 on the inner roof panel 230 can form a U-shaped recess 256 in which water-cooled pipes from the outer and inner roof panels extend. As illustrated, the U-shaped recess 256 is predominantly formed by the configuration of the inner roof panel 230. The cooling pipe 234 of the inner roof panel 230 includes an inlet and outlet 260, 262 (FIG. 6) through which cooling fluid flows to and from the cooling pipe 234. Tubes can connect the respective inlet and outlets 260, 262 to inlets and outlets 260*a*, 262*a* of the outer roof panel 200 to receive and discharge cooling fluid to and from the cooling pipe 208 of the outer roof panel. The inner roof panel can also include a header 270 for supplying fluid such as water to the cooling pipe sections.

Figure 4:
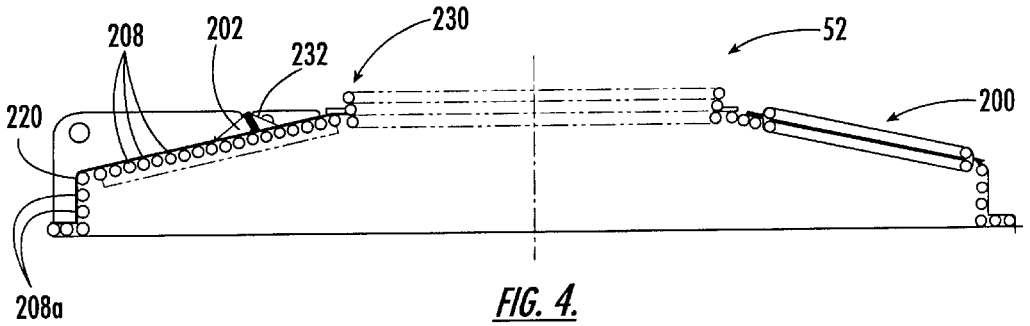
FIG. 4 is a schematic, sectional view of the water-cooled roof assembly taken along line 4—4 of FIG. 3A.
Figure 5:
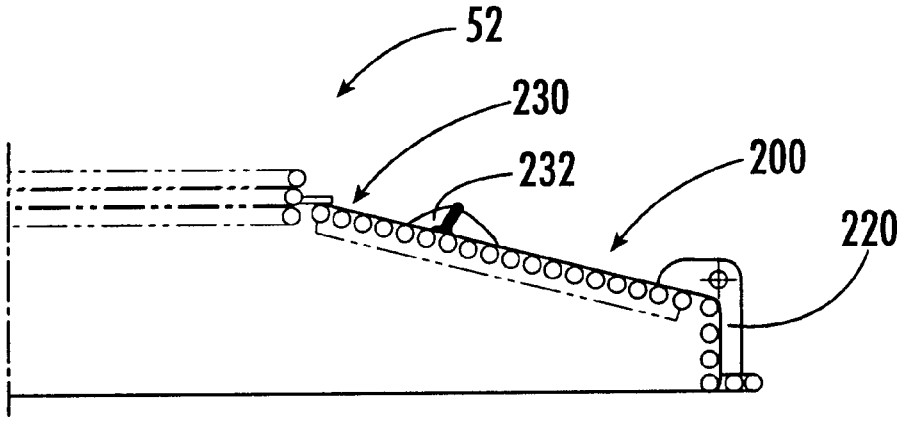
FIG. 5 is a schematic, sectional view of the water-cooled roof assembly taken along line 5—5 of FIG. 3A.
Figure 6:
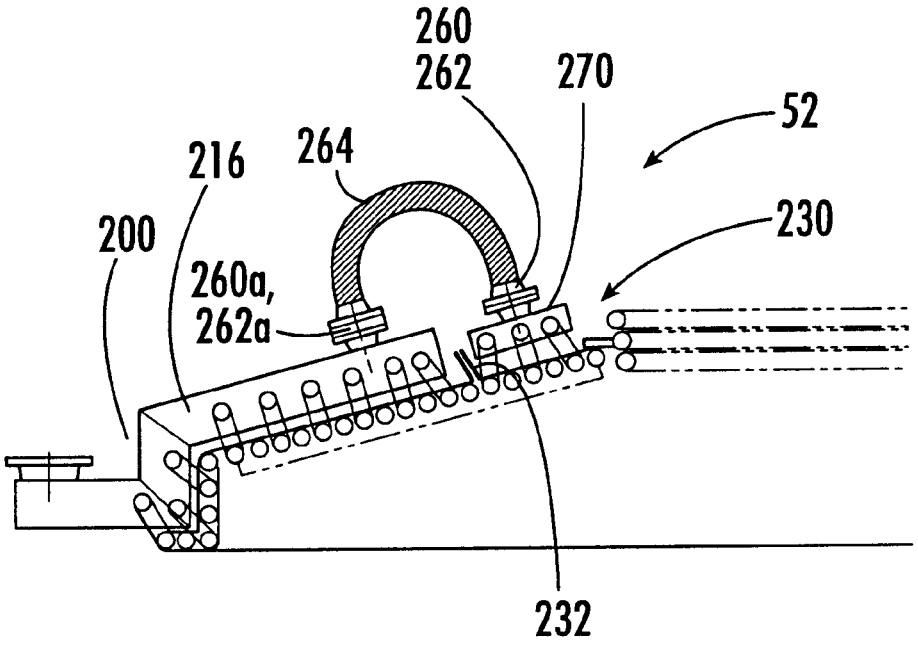
FIG. 6 is a schematic, sectional view of the water-cooled roof assembly taken along line 6—6 of FIG. 3A.

As illustrated in FIG. 4, the inner roof panel 230, outer roof panel 200 and central refractory 82 are substantially frustoconically shaped (arch design) to aid in dimensional stability to the roof assembly, such as known by those skilled in the art. The arch design imparts greater stability to the entire water-cooled roof assembly.

In operation, if the first two or three cooling pipes of the inner roof panel are damaged, the pins 242 connecting the inner roof panel 230 and outer roof panel 200 can be removed and the inner roof panel 230 and central refractory 82 can be removed without removing the outer roof panel 200 from the melting vessel. The mast support 62 and chains or other connection device can be connected to the inner roof panel 230 and central refractory 82. The mast support 62 can be pivoted to move the inner roof panel 230 and connected central refractory 82 away from the melting vessel. The inner roof panel, and if necessary central refractory, can then be replaced very quickly with another assembled unit. Additionally, if only the central refractory 82 is damaged due to the high heat generated by the electrodes, the pins could be removed from the inner roof panel that connect to the central refractory and the central refractory removed and replaced. However, typically the inner roof panel and central refractory are moved together as a unit.

Many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that the modifications and embodiments are intended to be included within the scope of the dependent claims.

That which is claimed is:

1. An electric arc furnace comprising:

a substantially cylindrically configured melting vessel having an upper shell defining a top opening; and a water-cooled roof assembly supported by the upper shell and positioned over the top opening, wherein said water-cooled roof assembly is removed from the top opening for permitting the charging of scrap into the melting vessel, said water-cooled roof assembly further comprising:

an annular configured, outer roof panel having an inner ring support member defining a central opening, an outer ring support member supported by the upper shell, and at least one cooling pipe forming a concentric series of water cooling pipes extending inward from the outer ring support member to the inner ring support member;

an annular configured, inner roof panel positioned within the central opening of said outer roof panel and removably mounted on the outer roof panel such that said inner roof panel is removed from the outer roof panel, said inner roof panel having at least one water cooling pipe and forming a concentric series of water cooling pipes extending inwardly, said inner roof panel including a central opening;

a central refractory removably mounted within the central opening of the inner roof panel; and at least one electrode mounted in the central refractory and extending into the melting vessel.

2. An electric arc furnace according to claim 1, wherein said outer ring support member comprises an annular configured skirt portion supported on said outer shell, wherein said cooling pipe on said outer roof panel includes a cooling pipe section that extends along said skirt portion.

3. An electric arc furnace according to claim 1, wherein said inner ring support member includes a circumferentially extending upper flange member, and said inner roof panel includes annular support member having a circumferentially extending outer flange member that is mounted on said upper flange member and supported thereby.

4. An electric arc furnace according to claim 3, including a plurality of pins that extend through said upper flange member and outer flange member for securing together said outer and inner roof panels.

5. An electric arc furnace according to claim 3, wherein said outer ring support member and annular support member form a U-shaped recess in which said cooling pipes from said outer and inner roof panels extend.

6. An electric arc furnace according to claim 1, wherein said inner roof panel further comprises an inner support surface, and said central refractory includes an outer flange support that mounts on said inner support surface.

7. An electric arc furnace according to claim 1, including a plurality of pins that extend through said inner roof panel and outer into said central refractory.

8. An electric arc furnace according to claim 1, wherein said cooling pipe of said inner roof panel includes an inlet and outlet through which cooling fluid flows to and from said cooling pipe, and including a tube connecting said inlet and outlet to a cooling pipe of said outer roof panel to receive and discharge cooling fluid to and from the cooling pipe of said outer roof panel.

9. An electric arc furnace according to claim 8, wherein said cooling pipe of said outer roof panel includes an inlet and outlet through which cooling fluid flows to and from said cooling pipe.

10. An electric arc furnace according to claim 1, wherein said outer roof panel, said inner roof panel, and central refractory are substantially frustoconically shaped to aid in dimensional stability to the roof assembly.

11. An electric arc furnace according to claim 1, further comprising a plurality of support ribs that extend along said outer roof panel from said outer ring support member to said inner ring support member.

12. An electric arc furnace according to claim 1, wherein said central refractory further comprises a water-cooled outer bevel.

13. An electric arc furnace according to claim 1, further comprising a mast support extending over said melting vessel and supporting said water-cooled roof assembly.

14. An electric arc furnace comprising:

a substantially cylindrically configured melting vessel having a plurality of water-cooled panels defining an inside surface of an upper shell and forming a top opening, and a lower shell having a slag door portion through which slag is discharged; and a water-cooled roof assembly supported by the upper shell and positioned over the top opening, wherein said water-cooled roof assembly is removed from the top opening for permitting the charging of scrap into the melting vessel, said water-cooled roof assembly further comprising:

an annular configured, outer roof panel having an inner ring support member defining a central opening, an outer ring support member supported by the upper shell, and at least one cooling pipe forming a concentric series of water cooling pipes extending inward from the outer ring support member to the inner ring support member;

an annular configured, inner roof panel positioned within the central opening of said outer roof panel and removably mounted on the outer roof panel such that said inner roof panel is removed from the outer roof panel, said inner roof panel having at least one water cooling pipe and forming a concentric series of water cooling pipes extending inwardly, said inner roof panel including a central opening;

a central refractory removably mounted within the central opening of the inner roof panel; and at least one electrode mounted in the central refractory and extending into the melting vessel.

15. An electric arc furnace according to claim 14, wherein said outer ring support member comprises an annular configured skirt portion supported on said outer shell, wherein said cooling pipe on said outer roof panel includes a cooling pipe section that extends along said skirt portion.

16. An electric arc furnace according to claim 14, wherein said inner ring support member includes a circumferentially extending upper flange member, and said inner roof panel includes an annular support member having a circumferentially extending outer flange member that is mounted on said upper flange member.

17. An electric arc furnace according to claim 16, including a plurality of pins that extend through said upper flange member and outer flange member for securing together said outer and inner roof panels.

18. An electric arc furnace according to claim 16, wherein said outer ring support member and annular support member form a U-shaped recess in which said cooling pipes from said outer and inner roof panels extend.

19. An electric arc furnace according to claim 14, wherein said inner roof panel further comprises an inner support surface, and said refractory includes an outer support flange that mounts on said inner support surface.

20. An electric arc furnace according to claim 19, including a plurality of pins that extend through said inner support surface of said inner roof panel and outer support flange of said refractory.

21. An electric arc furnace according to claim 14, further comprising an arcuate configured water-cooled panel having a lower end, including opposing side ends, and positioned above the slag door portion so that the lower end is angled inwardly away from an adjacent inside surface.

22. An electric arc furnace according to claim 14, wherein said cooling pipe of said inner roof panel includes an inlet and outlet through which cooling fluid flows to and from said cooling pipe, and including a tube connecting said inlet and outlet to a cooling pipe of said outer roof panel to receive and discharge cooling fluid to and from the cooling pipe of said outer roof panel.

23. An electric arc furnace according to claim 22, wherein said cooling pipe of said inner roof panel includes an inlet and outlet through which cooling fluid flows to and from said cooling pipe.

24. An electric arc furnace according to claim 14, wherein said outer roof panel, said inner roof panel, and central refractory are substantially frustoconically shaped to aid in dimensional stability to the roof assembly.

25. An electric arc furnace according to claim 14, further comprising a plurality of support ribs that extend along said outer roof panel from said outer ring support member to said inner ring support member.

26. An electric arc furnace according to claim 14, wherein said central refractory further comprises a water-cooled outer bevel.

27. An electric arc furnace according to claim 14, further comprising a mast support extending over said melting vessel and supporting said water-cooled roof assembly.

28. A water-cooled roof assembly for use with an electric arc furnace comprising:

an annular configured, outer roof panel having an inner ring support member defining a central opening, an outer ring support member, and at least one cooling pipe forming a concentric series of water cooling pipes extending inward from the outer ring support member to the inner ring support member;

an annular configured, inner roof panel positioned within the central opening of said outer roof panel and removably mounted on the outer roof panel such that said inner roof panel is removed from the outer roof panel, said inner roof panel having at least one cooling pipe and forming a concentric series of water cooling pipes extending inwardly, said inner roof panel including a central opening;

a central refractory removably mounted within the central opening of the inner roof panel.

29. A water-cooled roof assembly according to claim 28, wherein said outer ring support member comprises an annular configured skirt portion, wherein said cooling pipe on said outer roof panel includes a cooling pipe section that extends along said skirt portion.

30. A water-cooled roof assembly according to claim 28, wherein said inner ring support member includes a circumferentially extending upper flange member, and said inner roof panel includes an annular support member having a circumferentially extending outer flange member that is mounted on said upper flange member of said outer ring support member.

31. A water-cooled roof assembly according to claim 30, including a plurality of pins that extend through said upper flange member and outer support flange member for securing together said outer and inner roof panels.

32. A water-cooled roof assembly according to claim 30, wherein said outer ring support member and annular support member form a U-shaped recess in which said cooling pipes from said outer and inner roof panels extend.

33. A water-cooled roof assembly according to claim 28, wherein said inner roof panel further comprises an inner support surface, and said refractory includes an outer support flange that mounts on said inner support surface.

34. A water-cooled roof assembly according to claim 28, including a plurality of pins that extend through said inner roof panel and into said refractory.

35. A water-cooled roof assembly according to claim 28, wherein said cooling pipes are serpentine configured.

36. A water-cooled roof assembly according to claim 28, wherein said cooling pipe of said inner roof panel includes an inlet and outlet through which cooling fluid flows to and from said cooling pipe, and including a tube connecting said inlet and outlet to a cooling pipe of said outer roof panel to receive and discharge cooling fluid to and from the cooling pipe of said outer roof panel.

37. A water-cooled roof assembly according to claim 28, wherein said cooling pipe of said inner roof panel includes an inlet and outlet through which cooling fluid flows to and from said cooling pipe.

38. A water-cooled roof assembly according to claim 28, wherein said outer roof panel, said inner roof panel and central refractory are substantially frustoconically shaped to aid in dimensional stability to the roof assembly.

39. A water-cooled roof assembly according to claim 28, further comprising a plurality of support ribs that extend along said outer roof panel from said outer ring support member to said inner ring support member.

40. A water-cooled roof assembly according to claim 28, wherein said central refractory further comprises a water-cooled outer bevel.

41. A method of operating an electric arc furnace comprising the steps of:

charging scrap into a melting vessel by removing a water-cooled roof assembly of the melting vessel and placing scrap through an opening into the melting vessel, wherein the water-cooled roof assembly includes an annular configured, water-cooled outer roof panel having a central opening and an annular configured, a water-cooled inner roof panel positioned within the central opening of said outer roof panel and removably mounted on the outer roof panel and having a central opening, and a central refractory removably mounted within the central opening of the inner roof panel, and at least one electrode mounted in the central refractory and extending into the melting vessel;

closing the water-cooled roof assembly and generating an electric arc to the scrap through the at least one electrode extending through the water-cooled roof assembly of the melting vessel; and extending an oxygen lance through a slag discharge opening and into the melting vessel.

42. An electric arc furnace comprising:

a substantially cylindrically configured melting vessel having an upper shell defining a top opening; and a water-cooled roof assembly supported by the upper shell and positioned over the top opening, which is removed from the top opening for permitting the charging of scrap into the melting vessel, said water-cooled roof assembly further comprising:

an annular configured, water-cooled outer roof panel having an inner ring support member defining a central opening;

an annular configured, water-cooled inner roof panel positioned within the central opening of said outer roof panel and removably mounted on the inner ring support member, and including a central opening; and a central refractory removably mounted within the central opening of the inner roof panel for receiving at least one electrode mounted in the central refractory and extending into the melting vessel.

43. An electric arc furnace according to claim 42, wherein said outer roof panel includes at least one cooling pipe forming a concentric series of cooling pipes.

44. An electric arc furnace according to claim 42, wherein said inner roof panel includes at least one cooling pipe forming a concentric series of cooling pipes.

* * * * *

UNITED STATES PATENT AND TRADEMARK OFFICE

CERTIFICATE OF CORRECTION

PATENT NO. : 6,084,902
DATED : July 4, 2000
INVENTOR(S) : Hawk

It is certified that error appears in the above-identified patent and that said Letters Patent is hereby corrected as shown below:

Column 10, line 42 Delete:
"and outer"

Column 12, line 65 Delete:
"and"

Signed and Sealed this

First Day of May, 2001

*Attest:*

Nicholas P. Godici

NICHOLAS P. GODICI

*Attesting Officer*

*Acting Director of the United States Patent and Trademark Office*